United States Patent [19]

Staats

[11] 4,354,083

[45] Oct. 12, 1982

[54] MICROWAVE OVEN WITH NOVEL ENERGY DISTRIBUTION ARRANGEMENT

[75] Inventor: James E. Staats, Louisville, Ky.

[73] Assignee: General Electric Company, Louisville, Ky.

[21] Appl. No.: 204,126

[22] Filed: Nov. 5, 1980

[51] Int. Cl.[3] ..... H05B 6/72

[52] U.S. Cl. ..... 219/10.55 F

[58] Field of Search ..... 219/10.55 R, 10.55 F, 219/10.55 B, 10.55 M, 10.55 E, 10.55 A

[56] References Cited

U.S. PATENT DOCUMENTS

| | | | |
|---|---|---|---|
| 3,235,701 | 2/1966 | Duras et al. | 219/10.55 F |
| 3,701,872 | 10/1972 | Levinson | 219/10.55 E |
| 3,810,248 | 5/1974 | Risman et al. | 219/10.55 F |
| 3,814,890 | 6/1974 | Klemp et al. | 219/10.55 F |
| 3,851,133 | 11/1974 | Dygve et al. | 219/10.55 F |
| 4,019,009 | 4/1977 | Kusunoki et al. | 219/10.55 F |
| 4,065,654 | 12/1977 | Moore | 219/10.55 F |
| 4,165,454 | 8/1979 | Carlsson et al. | 219/10.55 F |
| 4,188,520 | 2/1980 | Dills | 219/10.55 B |
| 4,223,194 | 9/1980 | Fitzmayer | 219/10.55 F |

FOREIGN PATENT DOCUMENTS 1407852 9/1975 United Kingdom .

*Primary Examiner*—Arthur T. Grimley

*Attorney, Agent, or Firm*—H. Neil Houser; Radford M. Reams

[57] ABSTRACT

A microwave oven having an energy distribution system which produces efficient and uniform heating by utilizing a plurality of slotted feed apertures through which energy enters the top and bottom walls of the cooking chamber over a large area. A support shelf is provided for carrying an object to be heated and a rectangular waveguide is located immediately below the shelf which includes a first set of slots in its top wall to heat by use of near field effects and a second set of slots in its side walls which radiate energy toward reflecting surfaces in the bottom wall for further reflection upwardly into the chamber. A further set of feed apertures are located to pass energy into the chamber through the top wall thereof.

10 Claims, 4 Drawing Figures

MICROWAVE OVEN WITH NOVEL ENERGY DISTRIBUTION ARRANGEMENT

BACKGROUND OF THE INVENTION (1) Field of the Invention

This invention relates to a microwave heating apparatus, namely a microwave oven, for cooking foods and the like, in which electromagnetic high frequency waves are used to rapidly cook the foods and more particularly to a static energy delivery system for distributing microwave energy for efficient operation and improved cooking results.

(2) Description of the Prior Art

In using microwave ovens for heating or cooking, an ideal system of energy distribution would evenly distribute microwave energy across those portions of the cavity in which food was located. Since food is normally located in only a limited area of the oven it would also be desirable to maximize the energy in the portion of the cavity in which the food is to be located. Microwave ovens have employed numerous types of feed and distribution systems for this purpose.

In British Pat. No. 1,407,852 there is disclosed a microwave oven which utilizes "near field" effects of electromagnetic radiation to heat the foods. Near field heating is known to given considerably better results in heating foods having greatly differing dielectric properties. In order to accomplish this the food is maintained in close proximity with a radiation element, preferably less than one wavelength of the exciting electromagnetic energy. A waveguide is located underneath the food which has a plurality of slots. A food shelf is located directly over the waveguide to position the food in the near field. A removable reflector is located above the shelf by a distance not more than a wavelength of the applied microwave radiation. With the reflector in place, the oven constitutes a near field applicator; with the reflector removed, a resonance applicator.

U.S. Pat. No. 3,810,248 discloses a microwave apparatus in which heating of food is accomplished by placing the food in a support directly over slotted openings in a waveguide. Food is placed in a container so as to be heated concurrently by microwave energy acting directly on the food and by microwave energy acting indirectly by heating a radiation-absorbing layer in contact with the food.

U.S. Pat. No. 3,851,133 shows a microwave oven design directed to reducing the problem of uneven heating of foods in a microwave oven cooking cavity by providing an antenna chamber disposed adjacent the cooking cavity with microwave energy being introduced into the cavity through radiation slots disposed on the side of the cavity adjacent the antenna chamber. The antenna takes the form of radially extending arms rotating about a common axis.

U.S. Pat. No. 4,019,009 discloses a microwave oven which heats food by subjecting it to a microwave field generated by a surface wave transmission line comprising a slotted wall. The food may also be concurrently subjected to the far field effects of additional transmissions into a resonant heating cavity.

Other well known energy distribution microwave ovens rely heavily on the use of rotating devices within the cooking cavity. Most typically, a rotating mode stirrer is employed, the mode stirrer having blades and being driven by a motor cyclically varying the modes set up in the resonant cavity to thereby more evenly distribute the heating effect. Rotating food trays and rotating antennas have also been employed. Each of these approaches introduces motors, couplings and other complications, increasing the cost and reducing the reliability of the overall system.

OBJECTS OF THE INVENTION

In view of the foregoing, it is a general object of the present invention to provide a static energy distribution arrangement for a microwave oven which both improves the uniformity of heating and optimizes the heating efficiency at locations in the oven cavity at which food is most likely to be present.

Another object of the invention is the provision of an improved microwave oven having exceptionally efficient energy transfer from the microwave generating source to the object or food being heated.

A further object of the invention is a microwave energy delivery system for use in a microwave oven which utilizes both near field and far field heating to best advantage.

A still further object of the invention is the provision of a microwave oven capable of delivering a more uniform distribution of energy within the cooking chamber to thereby cook various types and configurations of food more evenly.

A further object is the provision of a microwave oven cooking cavity which is simple and inexpensive to construct and which does not rely on moving mode stirrer devices to produce uniform heating energy distribution in the cavity.

A further object is the provision of a microwave oven particularly adapted to concurrently heat food located at separate vertical levels or heights in a microwave oven cavity.

A still further object is the provision of a microwave energy distribution system which utilizes multiple energy passages through the bottom and top walls of the cooking cavity to thereby more evenly distribute energy within the cavity without the need for moving mode stirrers or antennas.

SUMMARY OF THE INVENTION

In order to accomplish the various objects noted above and others, the present invention utilizes the advantages of both near field and far field heating in a single microwave oven cavity to optimize the efficient and uniform heating of various divergent shapes of food normally cooked or heated therein.

To this end, there is provided a microwave cooking cavity of the resonant type, the caviity comprising a generally cubic enclosure defined by conductive walls. The cooking cavity is provided with a bottom waveguide positioned immediately below the bottom food supporting shelf adjacent the floor of the cavity. The top wall of this waveguide is provided with a first set of slots along substantially its entire length which emit radiation toward the food for absorption directly thereby without any intermediate reflection from other surfaces of the cooking cavity, thus using the near field effect to heat the food. There is further provided a second set of slots in the side walls of the waveguide and reflection means in line of sight relationship with the second set of slots below the level of the food to reflect and redirect microwave energy emitted through the side walls of the waveguide upwardly into the cooking cavity for absorption by the food after one or more reflections to thereby heat the food by using far field or reflected microwave energy. The reflection means comprise conductive surfaces arranged to maximize the reflection of energy through the side walls into the cooking cavity for impingement on the food at an angle which maximizes absorption of energy. The reflection surfaces also function to redirect energy impinging thereon from the cavity inwardly toward the food to be heated. An additional slotted top waveguide is provided above the cooking cavity via which additional microwave energy is transmitted into the cooking cavity through a plurality of slots to heat the food. The combined effect of top and bottom waveguide results in an improved uniformity of heating of food in the cavity.

BRIEF DESCRIPTION OF THE DRAWINGS.

These and other objects and features of the present invention will become apparent from the following description taken in conjunction with the accompanying drawings, in which.

DESCRIPTION OF THE PREFERRED EMBODIMENT

Figure 1:
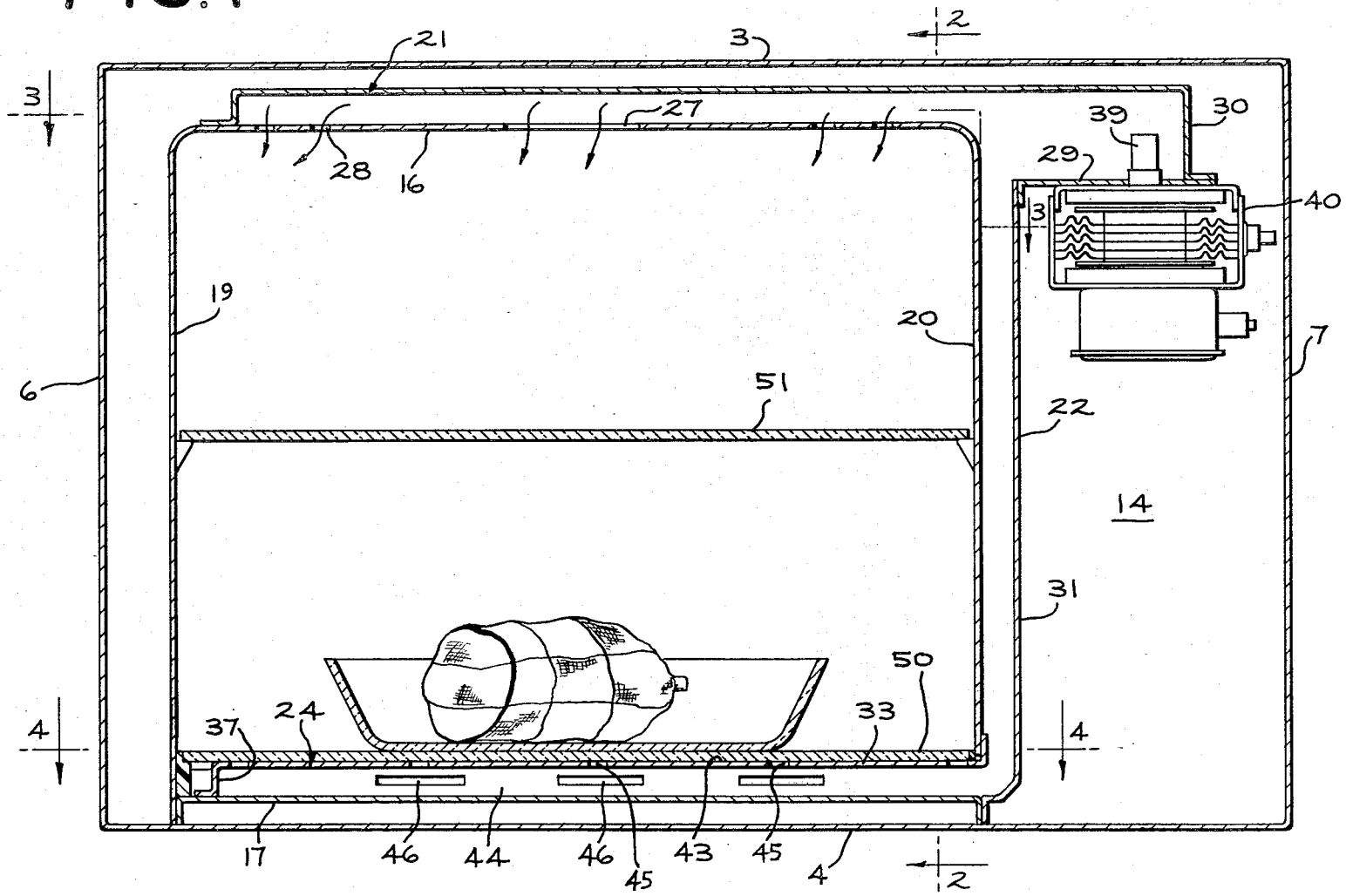
FIG. 1 is a front schematic sectional view of a microwave oven in accordance with the invention.

Referring now to FIGS. 1-4, there is shown a microwave heating apparatus according to the present invention which comprises a generally cubic outer cabinet 2 formed with six walls including upper and lower walls 3 and 4, a rear wall 5, two side walls 6 and 7, and a front wall partly formed by a hinged door 8. The space inside the cabinet 2 is divided generally into a cooking cavity or chamber 12 and a controls compartment 14. The cooking cavity 12 includes a top wall 16, a bottom wall 17, opposed side walls 19 and 20, and the rear wall 5. While the cooking cavity is shown, for ease of illustration, as sharing the common rear wall 5 with the outer cabinet, it is apparent that a separate rear wall which would attach to suitable flanges on the top, bottom and opposed side walls could have been provided for this purpose. The cooking cavity 12 is closed at the front by the access door 8.

The controls compartment 14 has mounted therein a magnetron 40 which is adapted to produce microwave energy having a frequency of approximately 2450 MHz at the output probe 39 thereof when coupled to a suitable source of power (not shown). In connection with the magnetron 40, a blower (not shown) to provide cooling airflow over the magnetron is provided. It is understood that numerous other components are required in a complete microwave oven which are not shown since they are all conventional and, as such, are well known to those skilled in the art.

Microwave energy is fed from the magnetron 40 to the oven cavity 12 through a coupling or transmission means, such as a waveguide, having a horizontally extending top branch or section 21, a vertically oriented side branch or section 22 and a horizontally extending bottom branch or section 24. The upper waveguide branch 21 runs centrally of the upper wall 16 of the cooking chamber and, as shown, is formed by an elongated member 25 having a generally U-shaped cross section which is attached by suitable means, such as welding, to the top wall 16 of the cooking cavity. The waveguide branch 21 includes two sets of feed passages 27 and 28 located in the wall 16, FIG. 3, through which microwave energy is transmitted into the top portion of the microwave cavity 12. The set of slots 28 are oriented transverse to the longitudinal dimension of the guide 21, while the sets 27 extend in directions parallel to the longitudinal dimension of the guide 21. The feed passages 27 and 28 are shown as being physically open slots in the wall 16 but may alternatively be closed with any material known in the art to be pervious to microwave energy.

The waveguide section 21 also includes wall portions 29 and 30 which extend beyond the cooking cavity in the direction of the magnetron 40 to serve as a launching area for microwave energy originating at the probe 39. The conductive wall 30 serves as a short circuiting waveguide termination and is spaced approximately one-sixth wavelength from the probe 39.

The side waveguide branch 22 runs in a vertical direction centrally of the cooking cavity side wall 20 and serves to couple the microwave energy from the magnetron 40 to the bottom waveguide branch 24. The waveguide branch 22 is formed jointly by the side wall 20 and an elongated member 31 having a generally U-shaped cross section and suitable flanges for attachment to the side wall 20.

The bottom waveguide section 24 runs horizontally across the center of the bottom wall 17 of the cooking cavity approximately underneath the top waveguide section 21. It is coupled to the side waveguide 22 on one end and includes a short circuiting termination wall 37 adjacent its other end.

The bottom waveguide section 24 is made up of a U-shaped in cross section member 33 attached to a flat central section 34 of the bottom wall 17 of the cooking cavity. The U-shaped member 33 includes a top wall 43 and integral side walls 44 extending downwardly toward the bottom wall of the cooking cavity. The side walls 44 have suitable flanges to facilitate attachment to the bottom wall in a conventional manner, such as by welding.

A first dielectric shelf or food support 50 comprising a thin planar member made of a microwave energy pervious material is supported immediately adjacent or resting on the top wall 43 of the waveguide section 24 so as to support food to be heated. A second support shelf 51, similar in construction, may be provided to support additional food to be heated in a position between the top and bottom walls of the cavity, preferably approximately midway therebetween.

The top wall 43 of the bottom waveguide section 24 has a first set of slots 45 which are spaced apart approximately equal distances along the length of section 21 and extend transverse to the longitudinal dimension of the guide 24. A second set of slots 46 are provided in side walls 44 along the length of guide 24.

Figure 2:
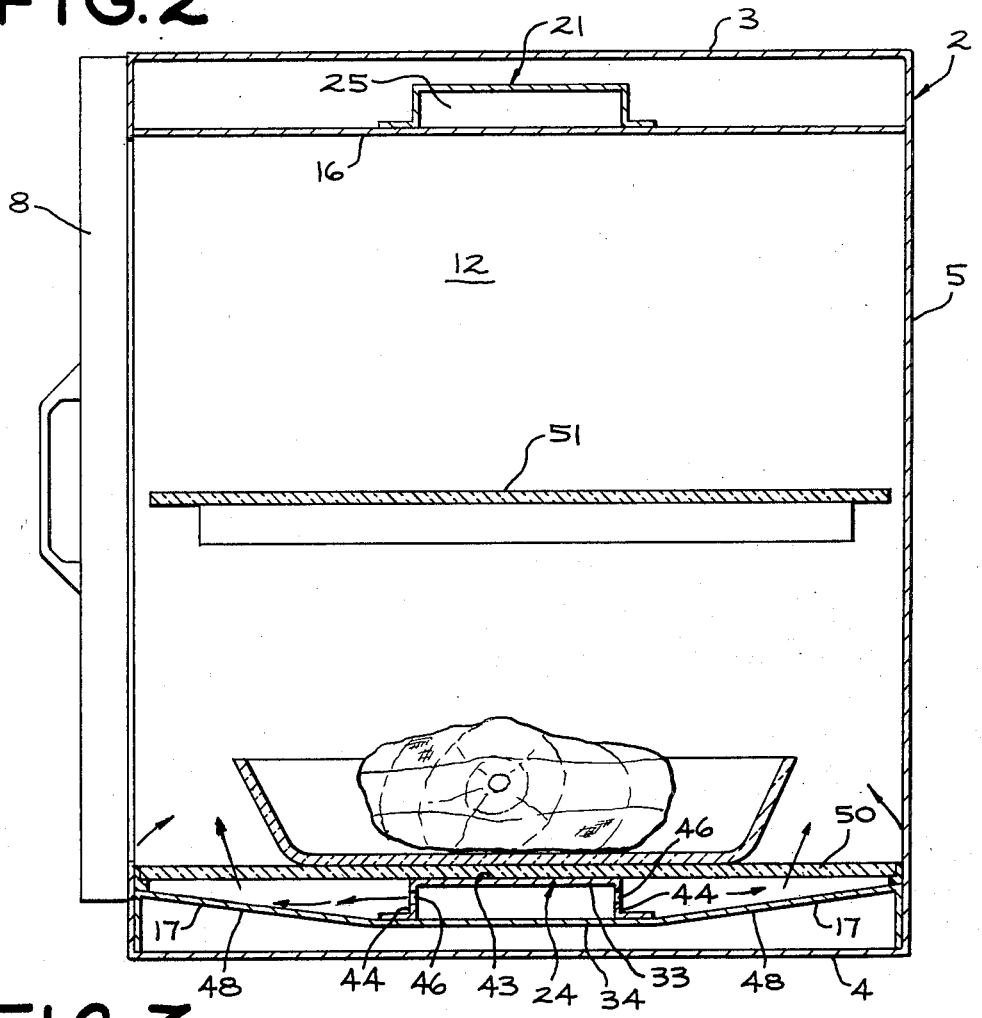
FIG. 2 is a schematic side sectional view taken generally along the lines 2—2 of FIG. 1.
Figure 3:
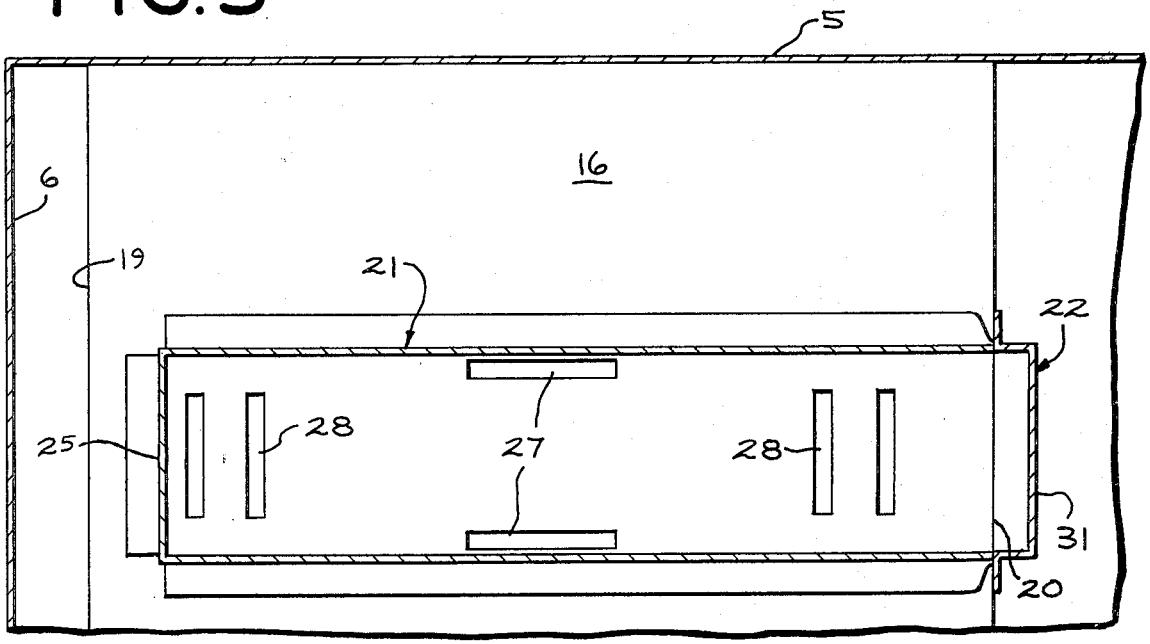
FIG. 3 is a schematic sectional view taken along the lines 3—3 of FIG. 1 showing the details of the slots in the top waveguide.
Figure 4:
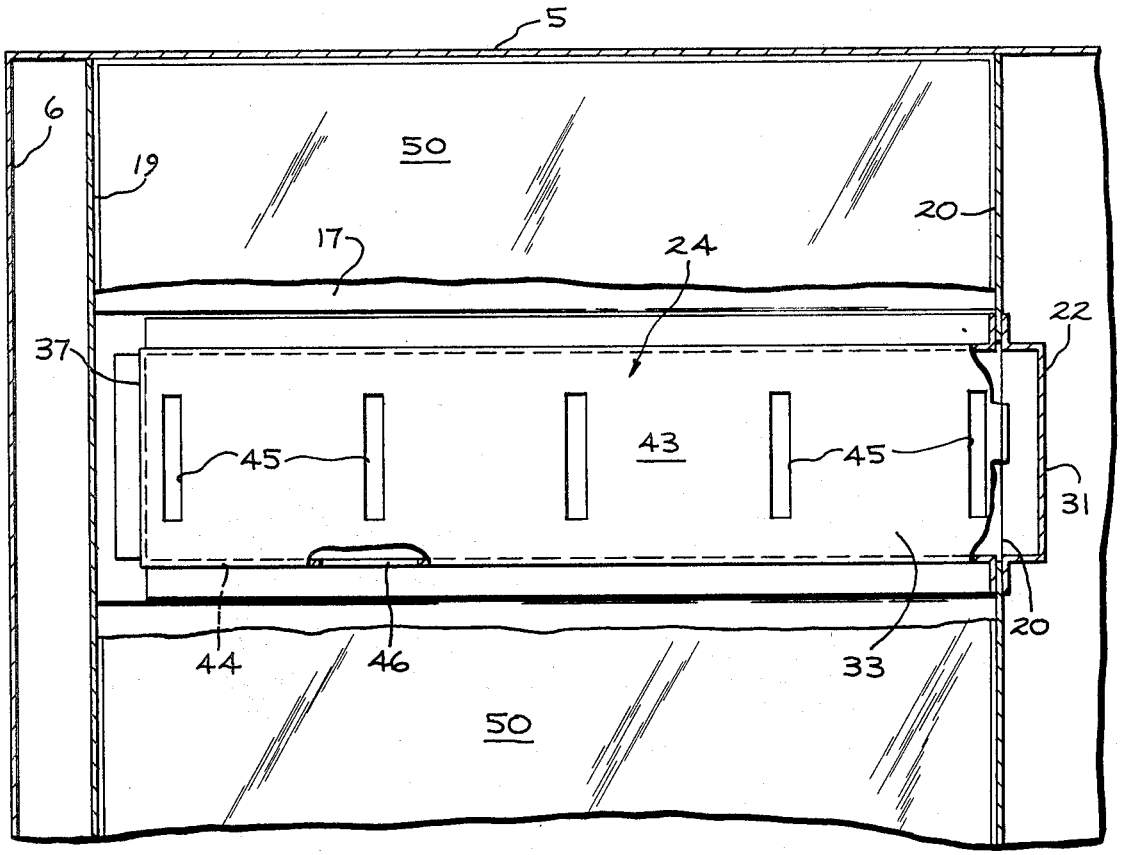
FIG. 4 is a schematic sectional view taken along the lines 4—4 of FIG. 1 showing details of the slots in the bottom waveguide.

The bottom wall 17 of the oven has surfaces 48, FIG. 2, bent or sloped upwardly between the waveguide section 24 and the front and rear walls of the cavity. The surfaces 48 operate primarily to reflect microwave energy entering the cavity via the set of slots 46 in the side walls 44 upwardly toward the food to be heated. The surface 48 also reflects additional microwaves impinging thereon from within the cavity and from the waveguide 21 but the predominant purpose of the angled surfaces 48 is to reflect energy emitted from slide side slots 46.

The dimensions of the waveguide sections 21, 22 and 24 are selected so that the $TE_{10}$ mode propagates therein. This is accomplished preferably by choosing the width of the section (the dimension running front to rear of the oven) to be more than one-half wavelength but less than one full wavelength and the height of the sections to be less than one-half wavelength.

The purpose of the slots 45 in the top wall 43 is to heat food located in the container supported on shelf 50 by use of near field effects. The use of the near field for this purpose is discussed in aforementioned British Pat. No. 1,407,852. In the near field, energy is transmitted by "transformer action," i.e., the field induces displacement currents in the load which in turn produce heat. Near field applications permit greater efficiency of heating and are less affected by variations in the dielectric properties of the load being heated.

In order to take advantage of the near field heating, the load must be located in the near field, i.e. substantially within the distance of one wavelength from the radiating element. This is required because the intensity of the near field drops off drastically as a function of increasing distance from the source, as explained in the aforementioned British patent. It is for this reason that the shelf 50 on which the food is to be carried is located immediately adjacent the slots 45 so that a maximum area of the food in the container is within a wavelength of the slots 45.

The slots 45 in the top wall of the waveguide are spaced apart by approximately one-fourth of the guide wavelength and are about ⅜ in. to ½ in. wide and slightly less than a quarter of a free-space wavelength long. It may be necessary to vary the distance between adjacent slots slightly as a function of distance from the microwave generator to even out the distribution of power from the slots. The exact spacing may be decided upon by evaluating the heating effect of the selected array within the cavity.

The second set of slots 46 in the side walls 44 of the bottom waveguide have the overall purpose of transmitting microwave energy toward the reflecting surfaces 48 for reflection upwardly into the main volume of the cooking cavity 12 for further reflection from the walls thereof onto the food to be heated. For this purpose, the slots 46 are selected to be generally larger than the slots 45 in the top wall so as to radiate a substantially greater amount of energy.

The slots 46 are typically a half wavelength long and about ⅜ in. to ½ in. wide, and while three are shown in the drawings a small number, more or less will operate satisfactorily. The centrally located side slots 46 may be made slightly larger to compensate for the greater spreading of energy and the reduced coupling effect from these slots.

The slots 27 and 28 are selected to evenly distribute microwave energy into the top of the oven chamber over a large area. To this end, each slot is generally selected and positioned to transmit energy to a specific quadrant of the oven cavity. Thus, the slots 27 tend to heat the front and back portions of the food, while the slots 28 tends to heat the right and left portions of the food. These slots 27 and 28 are about the same size as those in the side walls 44.

As indicated, the reflective surfaces 48 serve primarily to reflect microwave energy emitted from side slots 46 upwardly into the cavity 12 for impingement on the food at the Brewster angle which maximizes the absorption of energy thereby. The Brewster angle of a dielectric is that angle of incidence for which a wave polarized parallel to the plane of incidence is wholly transmitted (absorbed). In addition, the surfaces 48 tend to concentrate microwave energy received from the cavity 12 toward the center of the cavity in which the food is usually located. To this end, the reflective surfaces 48 are bent upwardly at an angle to the horizontal of between 3 degrees and 14 degrees. Stated another way, the surfaces 48 form angles with the front and back walls of the oven which are greater than right angles by between 3 and 14 degrees. The exact angle is chosen based on various parameters such as the dielectric constant of typical foods to be cooked in the oven and its location in the oven cavity. Using a typical food and oven construction, this angle averages about 8 degrees to the horizontal. With this construction, a maximum amount of energy from the slots 46 is reflected from surfaces 48, then from an adjacent back or front wall and impinges on the food at the Brewster angle.

While the angular reflective surfaces 48 are shown in the drawings in the bottom wall, it will be clear to those skilled in the art that such angular reflective surfaces could be located on other walls of the oven in an analogous manner. The overall result of redirecting energy impinging thereon from the interior of the cavity toward the central portions of the oven would take place. Nor is it necessary that such angled reflective surfaces be associated with a feed waveguide to perform this redirecting function. For example, an oven having only a top feed could usefully employ angled surfaces in the opposed bottom wall for the concentration of energy on the centrally located food.

In operation, energy from the magnetron 40 propagates toward the common junction area between the waveguide sections 21 and 22. At this junction area, the energy is split to propagate down both of the waveguide sections. The relative proportions of the energy delivered along each of the paths may vary considerably, but in the preferred arrangement approximately 50% of the energy is propagated in the top waveguide 21 while the remainder is transmitted down the waveguide section 22. The wave propagated in section 21 is transmitted into the top of the cooking cavity 12 via the feed passages 27 and 28 across substantially the entire width of the oven for impingement on the food to be heated either directly or after reflection from the cavity walls.

The microwave energy transmitted into the waveguide section 22 is propagated downwardly into the bottom waveguide 24. It exits the bottom waveguide via the two sets of feed slots 45 and 46.

Each of the slots 45 serves as a radiating element so that food in the container resting on shelf 50 is subject to the near field radiated by these slots. As indicated earlier, exposure of the food to the near field increases the efficiency of heating and to that end the object to be heated should cover as many of the slots 45 as possible. It is possible that some of the microwave energy from the slots 45 passes through the food, in which case it is reflected from the other interior walls of the cavity back onto the food. The efficiency and effect of the near field on the food in the container depends in part, of course, on the particular shapes of the food and the adsorption or dielectric characteristics thereof.

Microwave energy also exits concurrently through the side slots 46 of the bottom waveguides toward the reflecting surfaces 48. The angular orientation of the surfaces 48 may vary as noted above, but is chosen so that an optional portion of the microwave energy exiting the slots 46 will impinge on the food at the Brewster angle with the least number of reflections to maximize absorption of this energy by the food. Secondarily, the surfaces 48 function to redirect energy impinging thereon from the interior of the cavity toward the center of the cavity, or most likely location of the food being heated.

Thus, if food is contained on the shelf 50 only, it is subjected to mirowave energy from three prime sources, i.e., bottom slots 45, bottom slots 46, and top slots 27 and 28. Likewise, if food is placed on the shelf 51, this multiplicity of sources of energy enable rapid and even heating of both foods. Furthermore, the food placed on the shelf 51 no longer serves to block energy from reaching the food on shelf 50, thereby permitting better and more uniform cooking results when an oven is cooking two foods on different levels of the oven concurrently.

Having thus described in detail a preferred embodiment of the present invention, it will be apparent to those skilled in the art that certain of the structural elements described may be modified and that other elements may be substituted for performing similar functions without departing from the inventive principle; and it, therefore, is intended that all such modifications and substitutions be covered as are embraced within the spirit and scope of the invention.

What is claimed is:

1. A microwave oven comprising a resonant cooking chamber, a support shelf within said cooking chamber for carrying an object to be heated, a rectangular waveguide located below said support shelf, said waveguide having a top wall, and side walls extending perpendicular to said top wall, the top wall of said waveguide spaced not more than a wavelength of the applied microwave energy from said support, first openings in said top wall for radiating microwave energy toward said shelf, second openings in said side walls, microwave energy reflecting means spaced from said second openings in said side walls for reflecting microwave energy passing through said side wall openings upwardly toward said shelf.

2. The combination recited in claim 1 wherein said shelf is located with rspect to said top wall to position said object within one free-space operating wavelength of said top wall.

3. The combination recited in claim 2 wherein said reflective means comprise planar conductive surfaces arranged to maximize absorption by said object of microwave energy transmitted through said second openings.

4. The combination recited in claim 3 wherein said waveguide has a bottom wall, said bottom wall being integral with said conductive surfaces.

5. The combinations recited in claim 2 further including a rectangular waveguide located above said chamber for transmitting microwave energy downwardly into said chamber.

6. A microwave oven comprising a cooking cavity formed by conductive walls which jointly define a generally hollow cubic enclosure, one of said conductive walls comprising a reflecting surface which intersects at least one adjacent conductive wall at an angle within said cavity greater than a right angle, whereby energy impinging on said one conductive wall is reflected toward the center of said cavity, a rectangular waveguide formed on the cooking cavity side of one of said conductive walls, said waveguide having a top wall facing the center of said cavity and side wall perpendicular to said top wall, said top wall and at least one of said side walls having openings through which microwave energy is transmitted into said cavity.

7. The combination recited in claim 6 wherein said conductive walls include a top wall and a bottom wall joined by four orthogonally oriented side walls, said waveguide formed on said bottom wall.

8. The combination recited in claim 7 further including a planar food support shelf supported immediately adjacent said top wall of said waveguide.

9. The combination as recited in claim 7 wherein said reflective surface is formed by said bottom conductive wall and intersects each of an opposed pair of said conductive side walls at an angle within said cavity greater than a right angle.

10. The combination recited in claim 9 wherein each of said angles within said cavity exceeds a right angle by between 3 and 14 degrees.

* * * * *